US005277645A

United States Patent [19]

Kelley et al.

[11] Patent Number: 5,277,645

[45] Date of Patent: Jan. 11, 1994

[54] DOLL HAVING ACCESSORY DISPENSER

[75] Inventors: William J. Kelley, Torrance; Janet L. Unalp, Redondo Beach, both of Calif.

[73] Assignee: Mattel, Inc., El Segundo, Calif.

[21] Appl. No.: 832,249

[22] Filed: Feb. 7, 1992

[51] Int. Cl.[5] ..... A63H 3/00; A63H 33/04; A63H 13/02; A63H 3/16

[52] U.S. Cl. ..... 446/268; 221/24; 221/227; 428/3; 428/100; 434/81; 446/75; 446/296; 446/99; 446/475

[58] Field of Search ..... 428/3, 10, 28, 100; 221/24, 227, 230, 289; 434/81, 84, 95, 429; 446/268, 69, 71, 72, 75, 76, 295, 296, 97, 98, 99, 100, 337, 368, 372, 385, 472, 475, 901

[56] References Cited

U.S. PATENT DOCUMENTS

| | | | |
|---|---|---|---|
| 718,708 | 1/1903 | Geiger et al. | 428/28 X |
| 1,140,975 | 5/1915 | Frankel . | |
| 2,316,286 | 2/1943 | Reich | 446/268 X |
| 2,667,004 | 1/1954 | Sanson . | |
| 3,166,216 | 1/1965 | Guarr | 221/289 |
| 3,210,884 | 10/1965 | Sharff et al. | 446/100 |
| 3,223,412 | 12/1965 | Freeman et al. | 446/485 X |
| 3,528,079 | 9/1970 | Birch | 446/98 |
| 3,800,436 | 4/1974 | Matzek | 446/97 X |
| 3,841,019 | 10/1974 | Lorenzo | 446/98 X |
| 4,122,628 | 10/1978 | Crowell et al. . | |
| 4,220,016 | 9/1980 | Frenger . | |
| 4,406,296 | 9/1983 | Wexler et al. | 428/100 X |
| 4,543,278 | 9/1985 | Ackerman . | |
| 4,589,575 | 5/1986 | Rigberg et al. | 221/289 X |
| 4,671,514 | 6/1987 | Wilson-Diehl | 446/75 X |
| 4,968,279 | 11/1990 | Smith . | |
| 4,979,924 | 12/1990 | Manger . | |

*Primary Examiner*—Robert A. Hafer
*Assistant Examiner*—D. Neal Muir
*Attorney, Agent, or Firm*—Roy A. Ekstrand

[57] ABSTRACT

A doll includes a plurality of attachment pads distributed over the doll surface each having one portion of a conventional fabric attachment structure such as a hook and loop attachment means. A plurality of ornaments such as simulated jewels include undersurfaces bearing cooperating attachment pads intended to grasp the attachment pads upon the doll surface. A wand is configured to receive and support a plurality of jewel ornaments each having individual attachment pads. A dispensing mechanism is supported within the wand and is operative in response to an actuating button to provide sequential dispensing of the jeweled ornaments in a one at a time fashion to simulate a magical touch upon the selected surface.

7 Claims, 3 Drawing Sheets

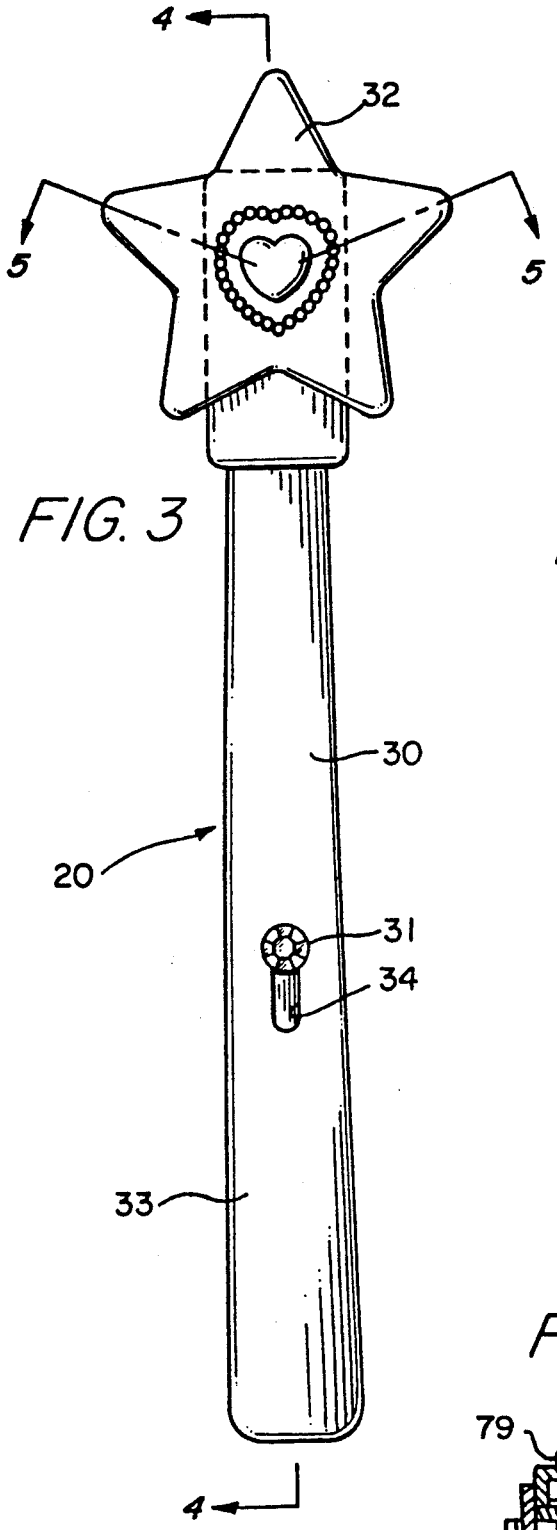
FIG. 3
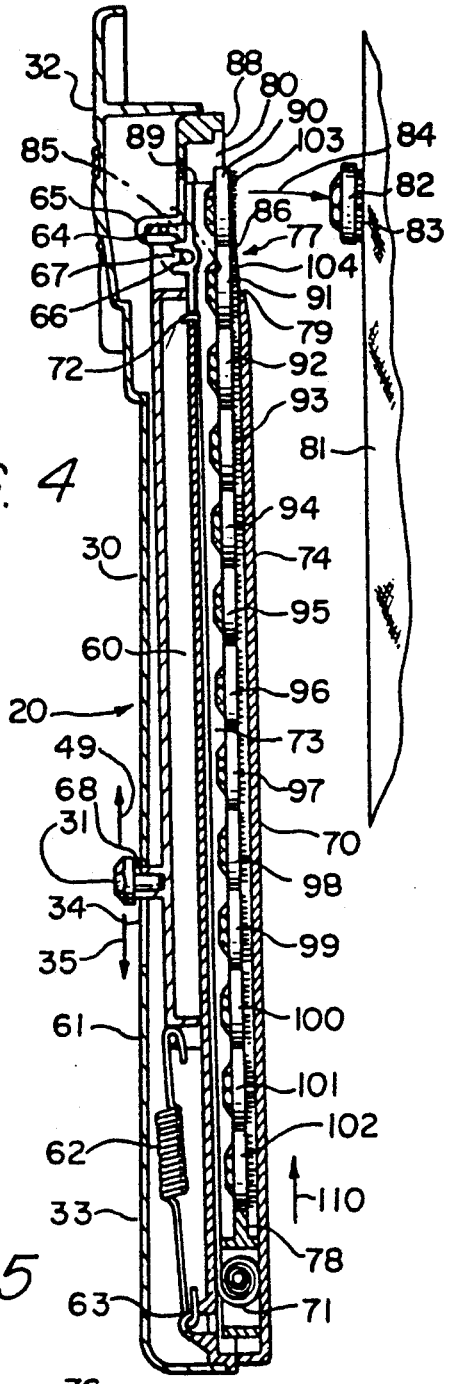
FIG. 4
FIG. 5
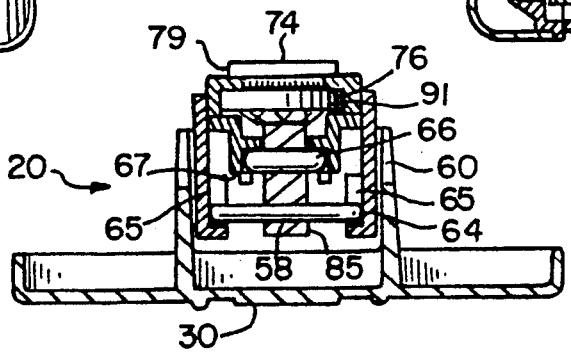

DOLL HAVING ACCESSORY DISPENSER

FIELD OF THE INVENTION

This invention relates generally to dolls and particularly to accessories used in combination therewith.

BACKGROUND OF THE INVENTION

One the more popular and pervasive toy species which has been in use by young children for a great many years is that generally referred to as dolls or toy figures. Within this broad character, one of the most popular types of dolls are generally referred to as "dress-up" type dolls which usually provide an attractive or pleasant appearance and include a variety of attractive and colorful clothes. Such dress-up dolls usually have attractive hair styles and are often "theme oriented" providing for play patterns which have included application of make-up, the ability to change the dolls clothes and otherwise alter the doll,s general appearance. In many dolls, the theme oriented character is further enhanced by themes having a more fanciful nature such as princess dolls or fairy godmother dolls or the like.

In their continuing efforts to enhance the appeal and play value of such dolls, practitioners in the art have generally included doll accessories such as crowns, tiaras, jewelry, magic wands and the like. The object of such accessories is often to mimic storybook or fantasy behavior as well as certain children's perception of adult behavior. However, to maintain interest value in such mimicry, a more fanciful or exaggerated version of the object or activity is usually preferred.

U.S. Pat. No. 1,140,975 issued to Frankel sets forth a BEAUTY MARK for use upon a wearer's skin such as facial areas. The beauty mark includes a sparkling stone or jewel together with a supporting base. The latter supports an adhesive layer used to attach the beauty mark object to the wearer's skin. Examples of beauty mark attachment are shown upon a female face near one eye and near the lips.

U.S. Pat. No. 2,667,004 issued to Sanson sets forth a DETACHABLE HOSIERY ORNAMENT for use in providing an appearance ornament which may be worn upon a female's hosiery or the like. The ornament includes a decorative element having an attachment backing secured thereto. A cooperating attachment member is positioned on the interior side of the hosiery in alignment with the ornament positioned on the exterior. Attachment is completed between the two attachment elements captivating the intervening portion of the wearer's hosiery.

U.S. Pat. No. 4,122,628 issued to Crowell, et al. sets forth a THREE-DIMENSIONAL DOLL having looped material extending smoothly across the surface of a stuffed soft doll. A plurality of changeable accessories support hooked under portions which form cooperating attachments with the looped material. Examples shown include a plurality of facial feature elements such as eyes, eyebrows, cheeks and mouth which may be multiply positioned in alternative configurations upon the doll's face to achieve a variety of facial expressions.

U.S. Pat. No. 4,979,924 issued to Manger sets forth a TOY KIT HAVING STUFFED ANIMAL-LIKE FIGURINE HAVING CHANGEABLE APPEARANCE in which a stuffed animal defining a generalized body and head of a four-legged animal is provided with a plurality of attachable elements which may be interchangeably secured to the animal body and head using hook and loop fabric attachments. Examples shown configure the basic animal into the fanciful appearance of a dog or, alternatively, an elephant.

U.S. Pat. No. 4,220,016 issued to Frenger sets forth SKIN JEWELRY which may be worn upon the skin of the wearer. The jewelry includes a decorative portion and a flexible resilient pad secured to the back side of the decorative portion. The latter provides for attachment to the skin of a wearer. The decorative portion may include a precious stone or artificial stone. In one embodiment, the stone provides a color change in response to the wearer's body heat.

U.S. Pat. No. 4,543,278 issued to Ackerman sets forth a TOY DISPLAY WALL HANGING used to removably store childrens' toys thereon. The wall hanging is formed in the configuration of a tree and carries hook patches of hook and loop attachment material. A plurality of cooperating loop patches are affixed to the back surfaces of the child's toy to permit removable attachment to the wall hanging.

U.S. Pat. No. 4,968,279 issued to Smith sets forth an INFANT TOY formed of a quilted fabric material stuffed with a resilient cotton batting to form a pillow-like body. A plurality of hook and loop fastening strips are secured at spaced locations on the front face of the body. A corresponding plurality of fabric patches having cooperating hook and loop fastening members may be removably securable to the fabric patches on the body. The removable patches are formed in a variety of ornamental and decorative shapes.

While the foregoing described prior art devices have, in their respective product areas, provided some improvement and increased interest value, there remains a continuing need within the toy and doll art for evermore interesting and amusing toys and dolls.

SUMMARY OF THE INVENTION

Accordingly, it is a general object of the present invention to provide an improved doll. It is a more particular object of the present invention to provide an improved doll having an interrelated accessory to further enhance its play value.

In accordance with the present invention, there is provided a doll having accessory dispenser comprises: a doll having a doll exterior and outer clothing supporting a first plurality of attachment pads; a plurality of accessories having a second plurality of attachment pads cooperating with the first plurality of attachment pads to attach the accessories to the doll exterior and doll clothing; and an accessory dispenser having means for receiving the plurality of accessories and for individually dispensing the accessories to facilitate attachment to the first plurality of attachment pads.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a front view of the accessory dispenser portion of the present invention doll and accessory dispenser;

FIG. 4 sets forth a section view of the accessory dispenser of FIG. 3 taken along section lines 4—4 in therein;

FIG. 5 sets forth a section view of the accessory dispenser shown in FIG. 3 taken along section lines 5—5 therein;

DESCRIPTION OF THE PREFERRED EMBODIMENT

Figure 1:
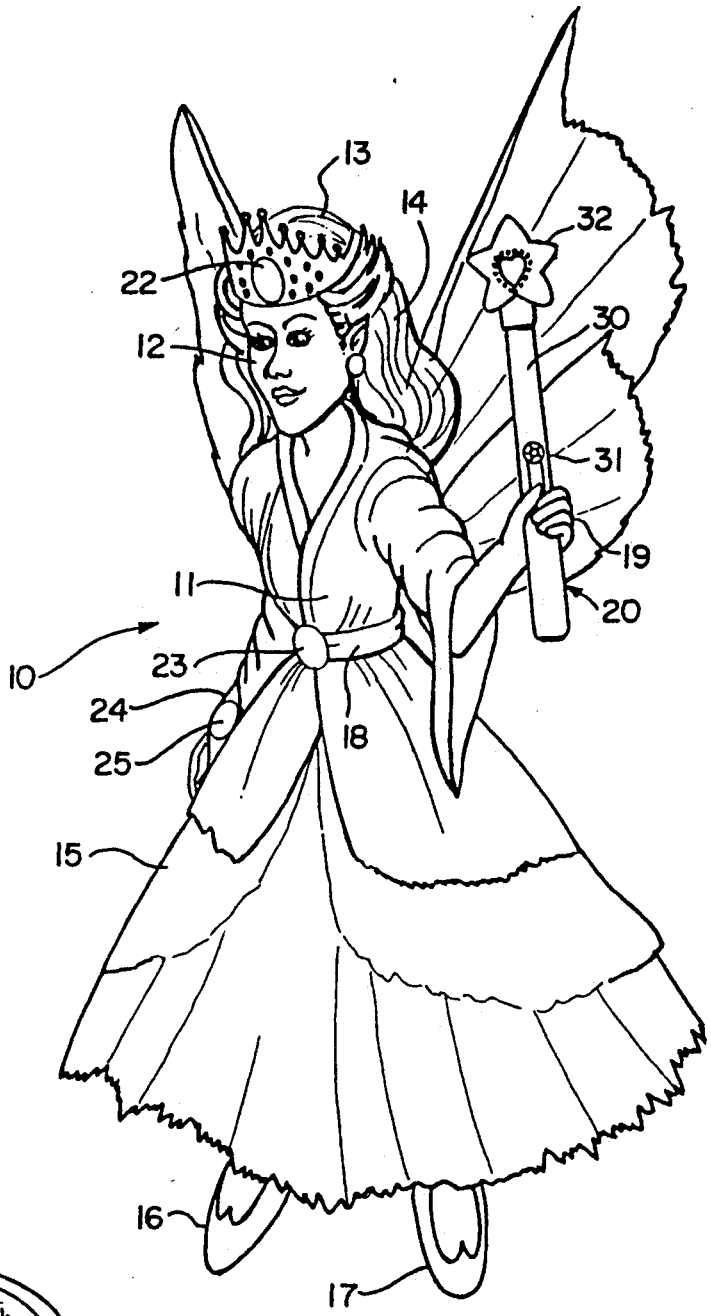
FIG. 1 sets forth a perspective view of a doll having an accessory dispenser constructed in accordance with the present invention.

FIG. 1 sets forth a perspective view of doll constructed in accordance with the present invention and generally referenced by numeral 10. Doll 10 includes a torso 11 supporting a head 12 and wearing a dress 15. Doll 10 further includes a quantity of simulated hair 14 and a tiara 13 resting upon head 12. Doll 10 further includes a pair of shoes 16 and 17 as well as a belt 18 and a bracelet 24.

In accordance with the present invention, doll 10 further includes an elongated wand generally referenced by numeral 20 having a housing 30 which supports a slidable button 31 and a decorative end portion 32. In further accordance with the present invention, doll 10 includes a belt 18 supporting an attachment pad 23 as well as an attachment pad 25 supported upon bracelet 24. In further accordance with the present invention, tiara 13 supports an attachment pad 22. Attachment pads 22, 23 and 25 are fabricated in accordance with conventional fabric hook and loop attachment devices such as those manufactured and sold under the trademark Velcro or the like. In further accordance with the present invention, shoes 16 and 17 are fabricated of a fabric having a surface which receives and adheres to the hook portion of a conventional fabric hook and loop attachment such as the above-referenced Velcro attachment means. Hand 19 of doll 10 is shown in FIG. 1 holding wand 20. In accordance with the present invention, wand 20 is removable from hand 19 and may be carried by the child user grasping wands 20 in the manner set forth below in FIG. 2. The important aspect to note in FIG. 1 in connection with the present invention is that doll 10 and wand 20 may be utilized in a conventional play pattern in which doll 10 assumes an interesting and pleasant appearance to the chilo user.

Figure 2:
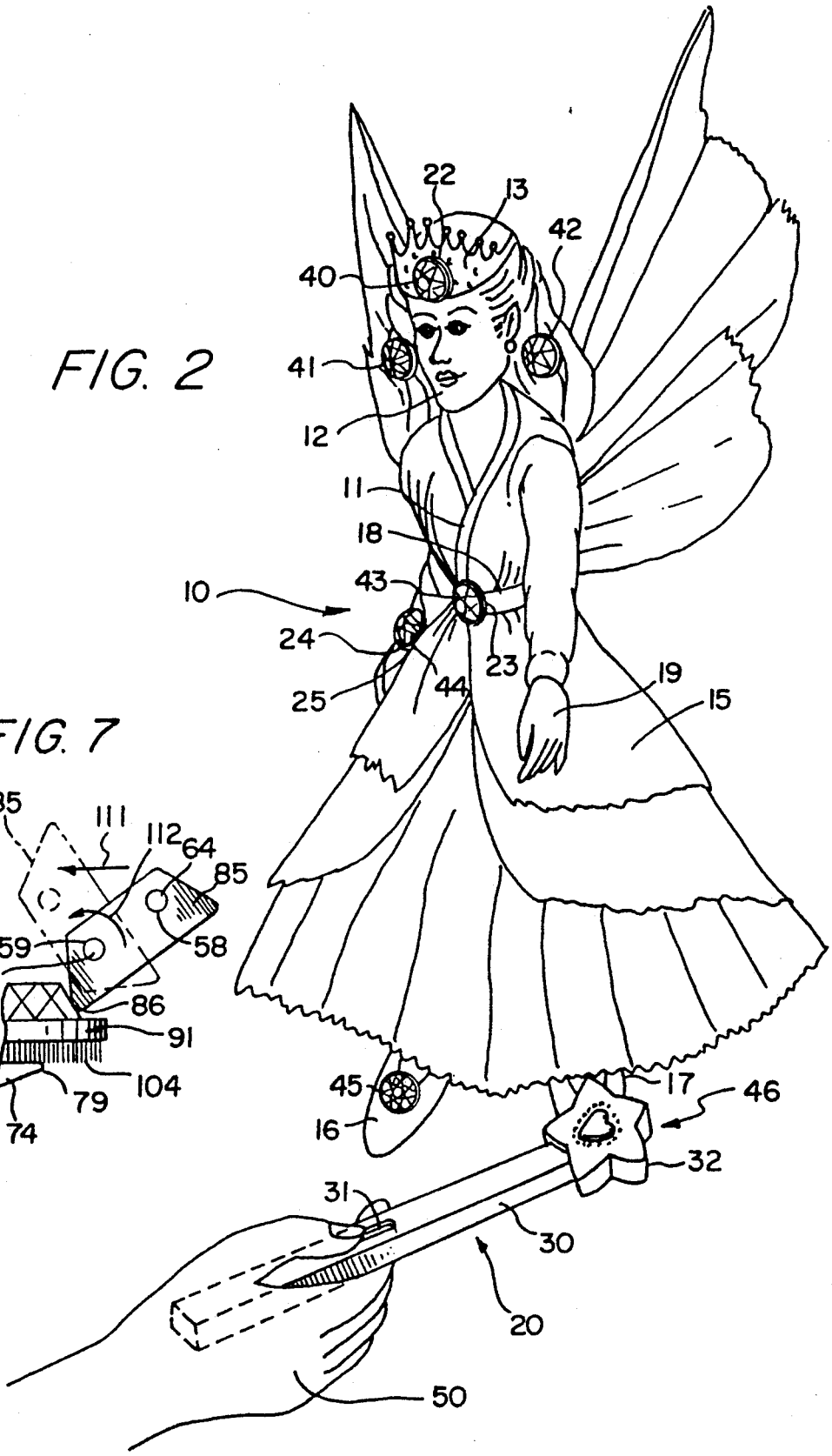
FIG. 2 sets forth a perspective view of the present invention doll and accessory dispenser in a typical play pattern.

FIG. 2 sets forth an alternate play pattern for the present invention doll having accessory dispenser in which wand 20 has been removed from hand 19 of doll 10 and is held by a child user having hand 50 grasping wand 20 in a typical operational grip. Accordingly, and by means set forth below in greater detail, wand 20 which includes an elongated housing 30, a decorative end 32 and slidable button 31 is grasped within hand 50 and extended outwardly toward doll 10. Also, by means set forth below in greater detail, the back and forth manipulation of button 31 on wand 20 produces a sequential dispensing of decorative jewel elements which, as is better seen in FIG. 6, include a fabric hook pad 52 suitable for cooperative attachment to the various attachment pads such as attachment pads 22, 23 and 25 upon the exterior of doll 10. For example, jewel 40 is has been manipulated to provide attachment of a plurality of decorative jewel ornaments at various places upon the exterior of doll 0. For example, jewel 40 is shown secured to attachment pad 22 on tiara 13. Similarly, a jewel 43 is shown attached to and supported by attachment pad 23 of belt 11 while jewel 44 is shown secured to attachment pad 25 of bracelet 24. In the operation shown in FIG. 2, the user, having installed an additional jewel 45 upon shoe 16, is about to install a final jewel 46 (seen in FIG. 6) upon shoe 17. As is set forth below in greater detail, the dispensing of the jewel ornaments by wand 20 is facilitated by the user's motion of sliding button 31 within wand 20. Suffice it to note here, however, that the plurality of jewels dispensed by the user are stored within wand 20 and dispensed one at a time each time button 31 is moved by the user and are caused to exit wand 20 from the underside of end portion 32. Thus, in the manner shown in FIG. 2, the user has placed end 32 above and resting upon shoe 17 having operated button 31 to dispense jewel 46 for attachment to shoe 17 in the same manner as shown for jewel 45 upon shoe 16.

In accordance with the attaching characteristic typical of the hook fabric portion of conventional hook and loop fasteners, additional jewels 41 and 42 are shown clinging to hair 14 of doll 10 to further enhance the appearance of doll 10. Thus, it will be apparent that the attaching property characteristic of such fabric attachment pads may be used advantageously in the present invention doll due to their characteristic of readily attaching to a variety of fabrics and surfaces in addition to the intended cooperating loop pads normally used with such hook and loop fastening fabric attachment means. It will be apparent to those skilled in the art, however, that while certain advantages are provided by utilizing the hook pad portion of a hook and loop fastener for the jewel pieces of the present invention, other attachment surfaces may be provided upon the jewel ornaments set forth herein without departing from the spirit and scope of the present invention. The essential feature of the attachment mechanism used on the jewel ornaments of the present invention is their ability to adhere to an intended surface and not the specific structure set forth as the preferred attachment means.

Thus, in the position shown in FIG. 2, a plurality of jewel ornaments 40 through 46 have been dispensed from wand 20 and secured to various portions of doll 10 to enhance the appearance thereof and provide an interesting play pattern for the child user. This play pattern is made more interesting by the use of wand 20 and its dispensing characteristic. In particular, the dispensing operation of wand 20 by which a plurality of jewel ornaments are dispensed in a one at a time fashion provides an interesting play pattern such as that seen by children in which a mythical wand is seen to impart a decorative jewel simply by touching the desired surface of doll 10. Other interesting play patterns may, of course, be created by the child user and added to the play value and interest of the present invention doll having an accessory dispenser.

FIG. 3 sets forth a front view of the dispensing wand of the present invention generally referenced by numeral 20. As described above, wand 20 includes an elongated housing 30 defining a slot 34 and an end portion 32. Housing 30 is formed such that one end thereof forms a convenient handle portion 33. A button 31 is slidably movable by the mechanism set forth below within slot 34.

FIG. 4 sets forth a section view of wand 20 taken along section lines 4—4 in FIG. 3. As described above, wand 20 includes a housing 30 having a handle portion 33 and an elongated slot 34 together with a decorative end portion 32 formed therein. An elongated frame 70 defines an interior channel 73 having a pair of opposed grooves 75 and 76 (better seen in FIG. 5) formed substantially over the length thereof. Frame 70 further defines an undersurface 74 terminating in an edge 79 to form an opening 77 at one end of frame 70. Frame 70 further defines an upwardly extending slot 67 which receives an elongated cylindrical pin 66. A piston 78 is slidably received within channel 73. An elongated spring 71, similar in fabrication to a conventional clock spring or the like, includes an end portion 72. Spring 71 is secured at end 72 to frame 70 and extends lengthwise through channel 73 and beyond piston 78. The remainder of spring 71 is coiled against piston 78 and provides a spring force applied to piston 78 in the direction indicated by arrow 110 urging piston 78 toward edge 79 within channel 73. Housing 30 is secured to channel 73 by conventional attachment means such as adhesive bonding, sonic welding or the like.

An elongated slide member 60 is slidably secured to frame 70 within the interior of housing 30. Slide 60 includes a generally cylindrical boss 68 extending upwardly through slot 34 of housing 30 and receiving button 31 in a secure attachment. Slide 60 further includes a post 61 having one end of a return spring 62 secured thereto. Correspondingly, frame 70 defines an eyelet 63 which receives the remaining end of return spring 62. Slide 60 extends beyond and partially encloses the end portion of frame 70 defining an end chamber 80. For reasons set forth in greater detail, end chamber 80 defines a recess 88. Slide 60 further defines a slot 65 which receives a cylindrical pin 64. A stop block 85 defines a generally, trapezoidal shape having a pair of apertures 58 and 59 (better seen in FIG. 7) which receives pins 64 and 66 respectively. Stop block 85 further defines an end portion 86 which, in the position shown in FIG. 4, extends downwardly into channel 73 of frame 70. A plurality of jewel ornaments 90 through 102 are received within channel 73 of frame 70 and supported therein in a linear array. As is better seen in FIG. 5, jewel elements 91 through 102 are received within grooves 75 and 76 of frame 70. Jewel element 90 is shown positioned prior to dispensing in accordance with the above-described operation.

In operation, the spring force provided by spring 71 upon piston 78 urges jewel ornaments 90 through 102 in the direction indicated by arrow 110. Spring 62 provides a return spring force operative upon slide 60 urging slide 60 in the direction indicated by arrow 35. Thus, the normal or rest position of slide 60 is that in which slide 60 moves in the direction indicated by arrow 35 until boss 68 reaches the end portion of slot 34. Concurrently, with slide 60 in its normal return position under the urging of spring 62, stop block 85 is rotated to the dashed-line position shown in FIG. 7. Concurrently, this return position of slide 60 positions end chamber 80 against end 89 of frame 70 such that jewel 90 is held by recess 88. Thus, with slide 60 in the return position, jewel 90 is maintained in the position shown and is captivated by end chamber 80 and recess 88 such that fabric hook pad 103 of jewel ornament 90 is exposed through opening 77 of frame 70. As a result, the movement of wand 20 in the direction indicated by arrow 84 toward a suitable fabric surface such as fabric 81 causes fabric hook pad 103 of the exposed underside of jewel ornament 90 to be brought into contact with the cooperating surface of fabric 81. The attachment which results secures jewel ornament 90 to fabric 81. Thereafter, the forward movement of button 31 within slot 34 of housing 30 in the direction indicated by arrow 49 moves slide 60 with respect to frame 70 in the corresponding direction.

FIG. 4 depicts the relative position of slide 60 with respect to frame 70 at the conclusion of the forward movement of button 31 within slot 34. As can be seen, end chamber and recess 88 of slide 60 have been moved away from jewel 90 which, in effect, releases jewel 90 to remain attached to fabric 81 due to the attaching characteristic of fabric hook pad 103 formed on the underside of jewel 90. The movement of slide 60 in the direction indicated by arrow 49 produces a relative motion between pins 64 and 66 causing stop block 85 to be rotated in the manner shown in FIG. 7. Thus, at the completion of the dispensing motion of slide 60, slide 60 and stop block 85 assume the position shown in FIG. 4 in which end portion 86 of stop block 85 is positioned within channel 73 of frame 70 so as to provide an obstruction which prevents additional jewel ornaments such as jewel ornament 91 from being driven from the interior of channel 73. But for the extension of end portion 86 of stop block 85 into channel 73, the force of spring 71 against piston 78 would drive additional jewel ornaments outwardly from channel 73. Thus, a single jewel ornament is dispensed with the operation of moving slide 60 in the manner indicated by arrow 49.

Once the attachment has formed between fabric hook pad 103 and fabric 81, the withdrawing of wand 20 away from fabric 81 leaves the dispensed jewel ornament attached to fabric 81. Thus, jewel ornament 82 having attachment pad 83 is shown secured to fabric 81 in the manner resulting from the operation of wand 20.

Figure 7:
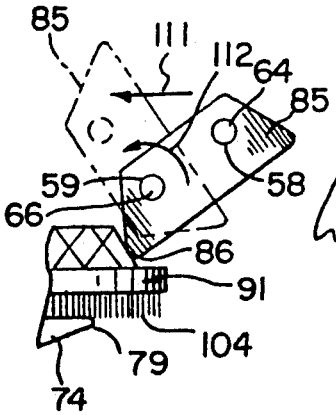
FIG. 7 sets forth a simplified diagram of a portion of the accessory dispenser of the present invention.

Once the desired jewel ornament has been dispensed, button 31 is released and spring 62 draws slide 60 in the direction indicated by arrow 35 which simultaneously moves end chamber 80 and recess 88 toward end 89 of frame 70 and moves pin 64 with respect to pin 66 causing stop block 85 to rotate in the manner shown in FIG. 7. As can be seen with temporary reference to FIG. 7 in which the return position of stop block 85 is shown in dashed-line representation, the rotation of stop block 85 releases the next jewel ornament within channel 73 which, in this case, is jewel ornament 91. With the release of jewel ornament 91, the spring force provided by spring 71 drives piston 78 against jewel ornaments 91 through 102 moving each jewel ornament in the direction indicated by arrow 110 until jewel ornament 91 assumes the position shown for jewel ornament 90 in FIG. 4. At this point, the travel of jewel ornament 91 is limited by its contact with recess 88 within end chamber 80 of slide 60 which, as mentioned above, has moved in the direction indicated by arrow 35 until it abuts end 89 of frame 70. At this point, the next jewel ornament (ornament 91 in this case) is then positioned to be released for attachment once button 31 is again moved in the direction indicated by arrow 49 which in turn moves slide 60 to the position shown in FIG. 4 and releases the jewel ornament and repeats the above cycle.

FIG. 5 sets forth a section view of wand 20 taken along section lines 5—5 in FIG. 3. As described above, wand 20 includes a housing 30 defining an end portion 32. A frame 70 defines an interior channel 73 which in turn defines a pair of outwardly extending grooves 75 and 76. Frame 70 defines an undersurface 74 which terminates in a transverse edge 79. A plurality of jewel ornaments fabricated as set forth above is received within channel 73 and aligned therein by grooves 75 and 76. For purposes of illustration, jewel 91 is shown within channel 73 due to jewel 90 having been removed in the above-described attachment. Frame 70 further defines a slot 67 which receives a generally cylindrical pin 66.

A movable slide 60 is slidably received upon frame 70 and defines a pair of slots 65 on either side thereof. Slots 65 receive a cylindrical pin 64. A generally trapezoidal stop block 85 defines a pair of apertures 58 and 59 which are received upon pins 64 and 66 respectively to provide rotatable attachment between stop block 85 and slide 60 and frame 70. In the position shown in FIG. 5, stop block 85 is positioned obstructing channel 73 due to the extension of end portion 86 of block 85. As described above, stop block 85 is rotated as relative motion between slide 60 and frame 70 is produced due to the user's manipulation of button 31 (seen in FIG. 4). As is also described above, this rotational motion moves end portion 86 away from its position obstructing channel 73 and permits the movement of the jewel ornaments supported therein.

Figure 6:
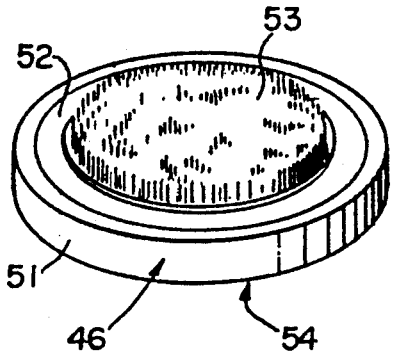
FIG. 6 sets forth a perspective of a typical simulated jewel constructed in accordance with the present invention in an inverted position.

FIG. 6 sets forth a perspective view of the underside of a typical jewel ornament generally referenced by numeral 46. Ornament 46 includes a generally disk-like member 51 having a simulated jewel stone 54 (seen in FIG. 2) supported on one side thereof and a pad of hook fabric attachment material 52 on the reverse side thereof. In accordance with the preferred fabrication of pad 52, a plurality of fabric hooks 53 extend from pad 52 and provide the attaching characteristic desired for jewel 46.

FIG. 7 sets forth a simplified diagram of the support and rotation of stop block 85 to better understand the motion thereof during the above-described dispensing process. Thus, FIG. 7 shows stop block 85 having a pair of apertures 58 and 59 which receive pins 64 and 66 of slide 60 and frame 70 respectively. A typical jewel ornament 91 is positioned beneath stop block 85 and includes an attachment pad 104. For purposes of reference, a portion of undersurface 74 of frame 70 defining edge 79 is also shown.

In FIG. 7, the solid-line representation of stop block 85 depicts the position of stop block 85 which occurs as button 31 is moved in the direction indicated by arrow 49 in FIG. 4. In this position, end portion 86 of block 85 intrudes into channel 73 of frame 70 (seen in FIG. 4) which obstructs jewel 91 from advancing beyond edge 79. As slide 60 moves in the direction indicated by arrow 111, pin 64 of slide 60 causes stop block 85 to pivot about pin 66 in the direction indicated by arrow 112. Once slide 60 has moved in the direction indicated by arrow 111 to its return position, stop block 85 assumes the dashed-line position shown in FIG. 7 which, as can be seen, moves end portion 86 of block 85 away from jewel 91 and thus clears channel 73 (seen in FIG. 4) to permit jewel 91 to advance beyond edge 79.

Thus, each time the above-described dispensing action is carried forward, stop block 85 is rotated from the dashed-line position shown in FIG. 7 to the solid-line position shown to provide temporary obstruction of channel 73 within frame 70 in order to prevent more than one jewel ornament to be forced outwardly from channel 73 by the action of spring 71 (seen in FIG. 4).

What has been shown is a novel doll having a dispensing apparatus which permits the sequential dispensing of a series of jeweled ornaments or other ornamental articles for attachment to various surfaces upon the doll. The dispensing apparatus is capable of use with other surfaces apart from the doll and provides an exciting play pattern in which the appearance is given of changing the surface touched by the end portion of the dispensing device while simultaneously moving the slidable release button. The child may quickly master the simple dispensing operation of the dispensing device to obtain a "magic-like" ouch of the dispensing device which gives the appearance of transforming the surface touched into a decorative jewel or other ornamental article.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll in combination with accessory dispenser comprising:

a doll having a doll exterior and outer clothing supporting a first plurality of attachment pads;

a plurality of accessories having a second plurality of attachment pads cooperating with said first plurality of attachment pads to attach said accessories to said doll exterior and doll clothing; and an accessory dispenser having a handle and resembling a wand having means for receiving said plurality of accessories and for individually dispensing said accessories to facilitate attachment to said first plurality of attachment pads.

2. A combination as set forth in claim 1 wherein said dispenser includes an elongated frame for supporting said plurality of accessories in a linear array.

3. A combination as set forth in claim 2 wherein said frame defines a first end having an opening therein and an interior channel in communication with said opening and means for supporting one of said accessories proximate said opening such that the attachment pad thereof is exposed through said opening.

4. A combination as set forth in claim 3 wherein said doll includes a hand formed to receive and support said dispenser.

5. A combination as set forth in claim 4 wherein said dispenser is configured to resemble a wand.

6. A combination as set forth in claim 5 wherein said accessories each include an ornamental element.

7. A combination as set forth in claim 6 wherein at least one of said ornamental elements is a simulated jewel.

* * * * *